US007320162B2

(12) United States Patent
Parker et al.

(10) Patent No.: US 7,320,162 B2
(45) Date of Patent: Jan. 22, 2008

(54) CASKET WITH MEMORABILIA MOUNTING AND DISPLAY DEVICES

(75) Inventors: Daniel J. Parker, Connersville, IN (US); Jamie D. Riddle, Sunman, IN (US)

(73) Assignee: Batesville Services, Inc., Batesville, IN (US)

( * ) Notice: Subject to any disclaimer, the term of this patent is extended or adjusted under 35 U.S.C. 154(b) by 147 days.

(21) Appl. No.: 11/000,801

(22) Filed: Dec. 1, 2004

(65) Prior Publication Data

US 2006/0112527 A1 Jun. 1, 2006

(51) Int. Cl.
*A61G 17/00* (2006.01)

(52) U.S. Cl. ..... 27/19; 27/16

(58) Field of Classification Search ..... 27/19, 27/2, 14, 16, 1; D99/2, 3, 8, 12
See application file for complete search history.

(56) References Cited

U.S. PATENT DOCUMENTS

| | | | | |
|---|---|---|---|---|
| D19,506 | S | 12/1889 | Kagelmacher | |
| 422,084 | A | 2/1890 | Learman | |
| 443,209 | A | 12/1890 | Ripsom | |
| 494,297 | A | 3/1893 | Leonhardt | |
| 586,071 | A * | 7/1897 | Loomis | 27/16 |
| 1,596,812 | A * | 8/1926 | Curtis et al. | 211/119.002 |
| 2,234,512 | A * | 3/1941 | Wilson | 248/206.3 |
| 2,594,722 | A * | 4/1952 | Bell | 248/27.8 |
| 2,835,014 | A | 5/1958 | Dioguardi, Jr. | |
| 4,457,054 | A | 7/1984 | Craft et al. | 27/1 |
| 5,533,241 | A | 7/1996 | McConnell | 27/27 |
| 5,611,124 | A | 3/1997 | Biondo et al. | 27/2 |
| 5,675,876 | A | 10/1997 | Benedict et al. | 27/2 |
| 5,678,289 | A | 10/1997 | Saaf | 27/2 |
| 5,727,291 | A | 3/1998 | Biondo et al. | 27/2 |
| 5,813,099 | A | 9/1998 | Stewart | 27/2 |
| 5,887,321 | A | 3/1999 | Foley, Jr. | 27/2 |
| 6,237,202 | B1 * | 5/2001 | Agee et al. | 27/14 |
| 6,257,423 | B1 | 7/2001 | Riga et al. | 211/85.16 |
| 6,324,736 | B1 | 12/2001 | Atrio | 27/2 |
| 6,715,190 | B2 | 4/2004 | Groemminger et al. | 27/19 |
| 6,836,936 | B1 | 1/2005 | Biondo et al. | 27/2 |
| 6,898,830 | B1 | 5/2005 | Acton et al. | 27/2 |
| 2004/0040130 | A1 * | 3/2004 | Teague | 27/19 |
| 2006/0048353 | A1 * | 3/2006 | Brinneman | 27/2 |

* cited by examiner

*Primary Examiner*—William L. Miller
(74) *Attorney, Agent, or Firm*—Wood, Herron & Evans LLP

(57) ABSTRACT

A casket comprises a casket shell having a pair of side walls, a pair of end walls, and a floor, at least one lid securable to the casket shell, a memorabilia mounting device secured to the at least one lid and extending along at least a portion of a perimeter thereof, and a memorabilia display device mounted to the memorabilia mounting device for displaying memorabilia memorializing a deceased.

38 Claims, 6 Drawing Sheets

CASKET WITH MEMORABILIA MOUNTING AND DISPLAY DEVICES

FIELD OF THE INVENTION

This invention relates generally to caskets, and more particularly to caskets of the type including memorialization features for mounting and displaying memorabilia relating to the deceased on the casket.

BACKGROUND OF THE INVENTION

There is a trend in the death care industry to make efforts towards "personalizing" the funeral products and the funeral or other services purchased for the deceased to provide a more meaningful burial service experience for the family and friends of the deceased. Oftentimes, there is a desire on the part of the deceased's family and loved ones to memorialize the faithfully departed. This may manifest itself in several ways such as, for example, displaying various religious or sentimental items close to or on the casket during viewing of the deceased or even placing items in the casket prior to interment of the casket into the ground. The display and/or storage of various items of personalty near or in caskets has existed as a means to memorialize the deceased.

One of the earlier attempts at providing a means of personalizing or customizing a casket to the deceased may be seen with reference to the assignee's U.S. Pat. No. 4,457,054 titled Casket Shelf. That patent discloses a casket shelf which is mounted to the dish assembly of the head end cap when the head end cap is in the open position, such as during viewing of the deceased. The shelf provides a surface for supporting and displaying articles of religious or personal significance to the deceased. Additionally, the assignee's pending U.S. patent application Ser. No. 09/788,769 filed on Feb. 20, 2001 and titled Memorialization Casket discloses an alcove structure having a recess for mounting and displaying an ornament as a means of memorializing the deceased.

Furthermore, many current caskets do not provide any designated, easily accessibly receptacle or compartment for either the display of personal effects of the deceased therein or the inclusion therein of mementos of memorialization by the deceased's family and friends. Prior attempts at solving this shortcoming have generally taken the form of the placement of a small memento box into the casket alongside the deceased. However, such memento boxes often appear as an afterthought, simply placed alongside the deceased in the casket somewhat haphazardly. A casket having a memorabilia compartment integral to the casket for storing mementos and other items of memorabilia may be seen with reference to the assignee's U.S. Pat. No. 5,611,124 titled Casket Having Memorabilia Compartment. Caskets having a memorabilia compartment or drawer in which keepsakes of the deceased can be stored and displayed are commercially available as the MemorySafe® line of caskets available from Batesville®.

Advances have therefore been made in the area of "personalization" of funeral products by displaying and storing memorabilia, as demonstrated by the patents and products discussed above. However, there continues to be room for improvement in the area of providing caskets with memorabilia display and storage.

SUMMARY OF THE INVENTION

In one aspect the invention is a casket comprising a casket shell having a pair of side walls, a pair of end walls, and a floor, at least one lid securable to the casket shell, a memorabilia mounting device secured to the at least one lid and extending along at least a portion of a perimeter thereof, and a memorabilia display device mounted to the memorabilia mounting device for displaying memorabilia memorializing a deceased.

The memorabilia mounting device can extend around the perimeter of the at least one lid. The casket can include a pair of lids having abutting end edges. The memorabilia mounting device can extend along at least a portion of the perimeter of both of the lids, can extend along at least a portion of the perimeter of both of the lids excepting the abutting end edges of the lids, or can extend around the perimeter of both of the lids excepting the abutting end edges of the lids.

The memorabilia mounting device can be a rail.

The memorabilia display device can be a wire rack, a table top, a table register, or a tray.

In another aspect, a casket comprises a casket shell having a pair of side walls, a pair of end walls, and a floor, at least one lid securable to the casket shell, a memorabilia mounting rail secured to the at least one lid and extending along at least a portion of a perimeter thereof, and a memorabilia display device mounted to the memorabilia mounting rail for displaying memorabilia memorializing a deceased.

The memorabilia mounting rail can include interconnected upper and lower rails, or an outer rail pair and an inner rail pair, the outer rail pair having interconnected upper and lower rails, the inner rail pair having interconnected upper and lower rails.

In yet another aspect, a casket comprises a casket shell having a pair of side walls, a pair of end walls, and a floor, at least one lid securable to the casket shell, a memorabilia mounting rail secured to the at least one lid and extending along at least a portion of a perimeter thereof, a memorabilia display device mounted to the memorabilia mounting rail for displaying memorabilia memorializing a deceased, and an attachment device for attaching the memorabilia display device to the memorabilia mounting rail.

The attachment device can be a spring clip, a pressure fit tab lock, a detent and ball, a flexible plastic clip, a half turn lock, or a spring loaded lever clamp.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
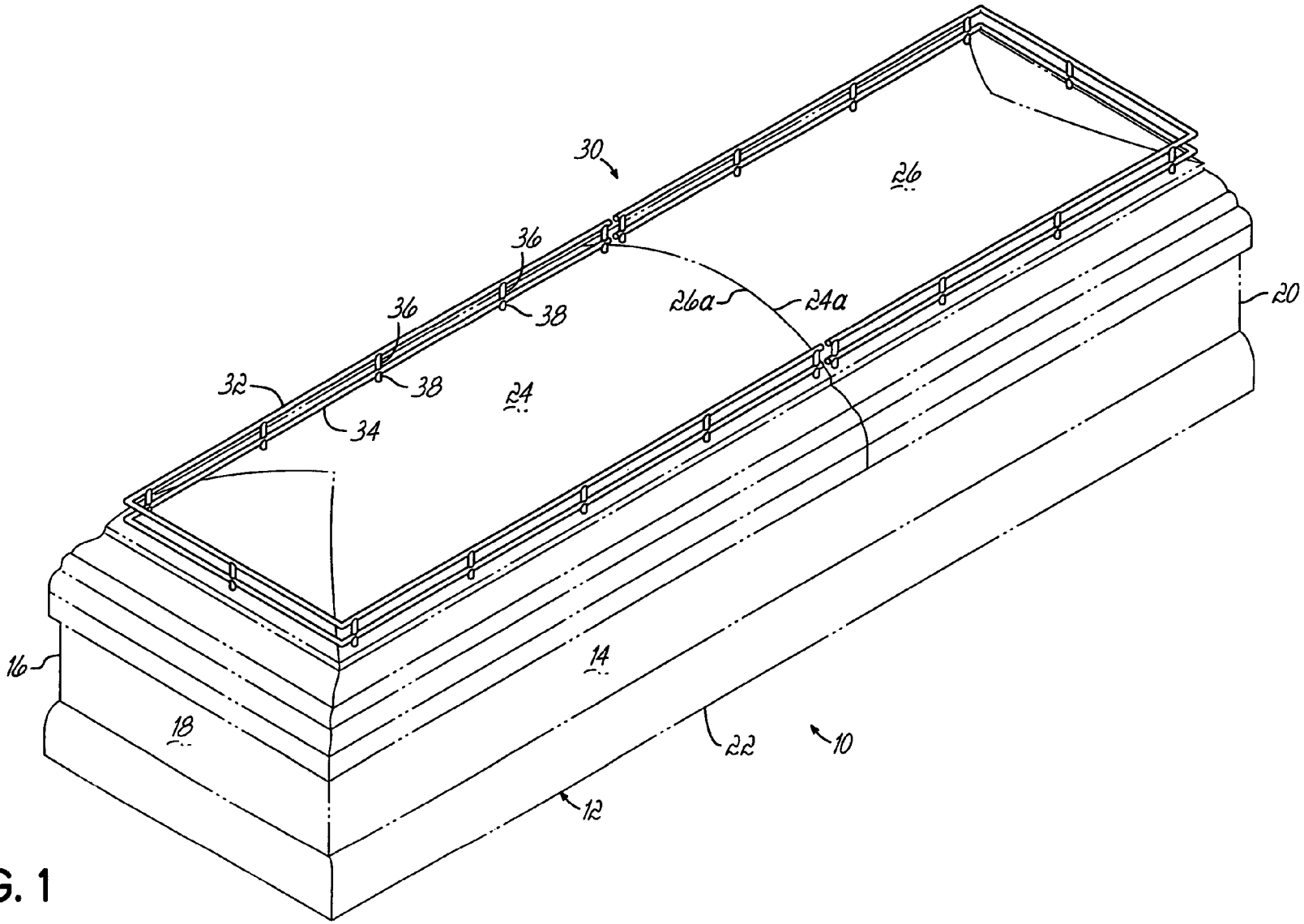
FIG. 1 is a perspective view of a casket including a memorabilia mounting device according to the principles of the present invention.

With reference to FIG. 1, there is illustrated a casket 10 constructed according to the principles of the present invention. Casket 10 includes a casket shell 12 having a pair of side walls 14, 16, a pair of end walls 18, 20, and a floor 22. Casket 10 further includes at least one lid, and, as illustrated, can have a pair of lids 24, 26 securable to shell 12 as by hinges or by other means known to those skilled in the art. Casket 10 can further include handle bars, decorative adornments, etc. as is know to those skilled in the art (not shown).

Figure 3:
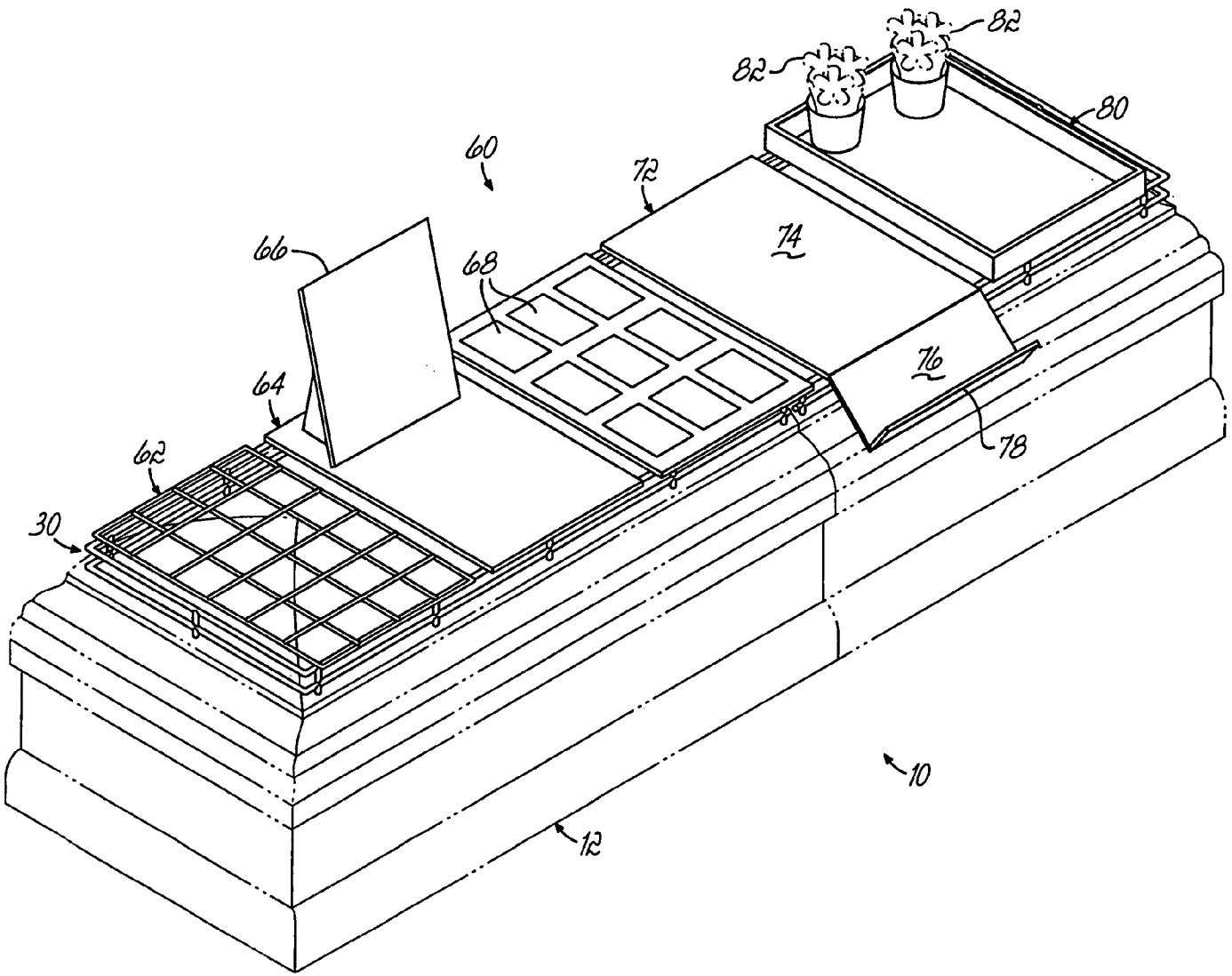
FIG. 3 is a view similar to FIGS. 1 and 2 illustrating several memorabilia display devices for mounting on the memorabilia mounting devices of FIGS. 1 and 2.

Casket 10 includes a memorabilia mounting device 30 and one or more memorabilia display devices 60 (FIG. 3). Referring to FIG. 1, memorabilia mounting device 30 can take the form of one or more rails mounted to lids 24, 26 extending along at least a portion of their periphery. As illustrated, the FIG. 1 memorabilia mounting device 30 can include an upper rail 32 and a lower rail 34. The rails 32 and 34 can be interconnected with interconnecting rail portions 36. Lower rail 34 can be connected to lids 24, 26 with connecting rail portions 38 secured to lids 24, 26 by any suitable fastener. To facilitate opening the lids 24, 26 the rails 32, 34 can be discontinuous at the abutting end edges 24*a*, 26*a* of the lids 24, 26, respectively. The rails 32, 34 can extend around the periphery of both of the lids 24, 26 except for the abutting end edges 24*a*, 26*a* of the lids 24, 26, respectively.

Figure 2:
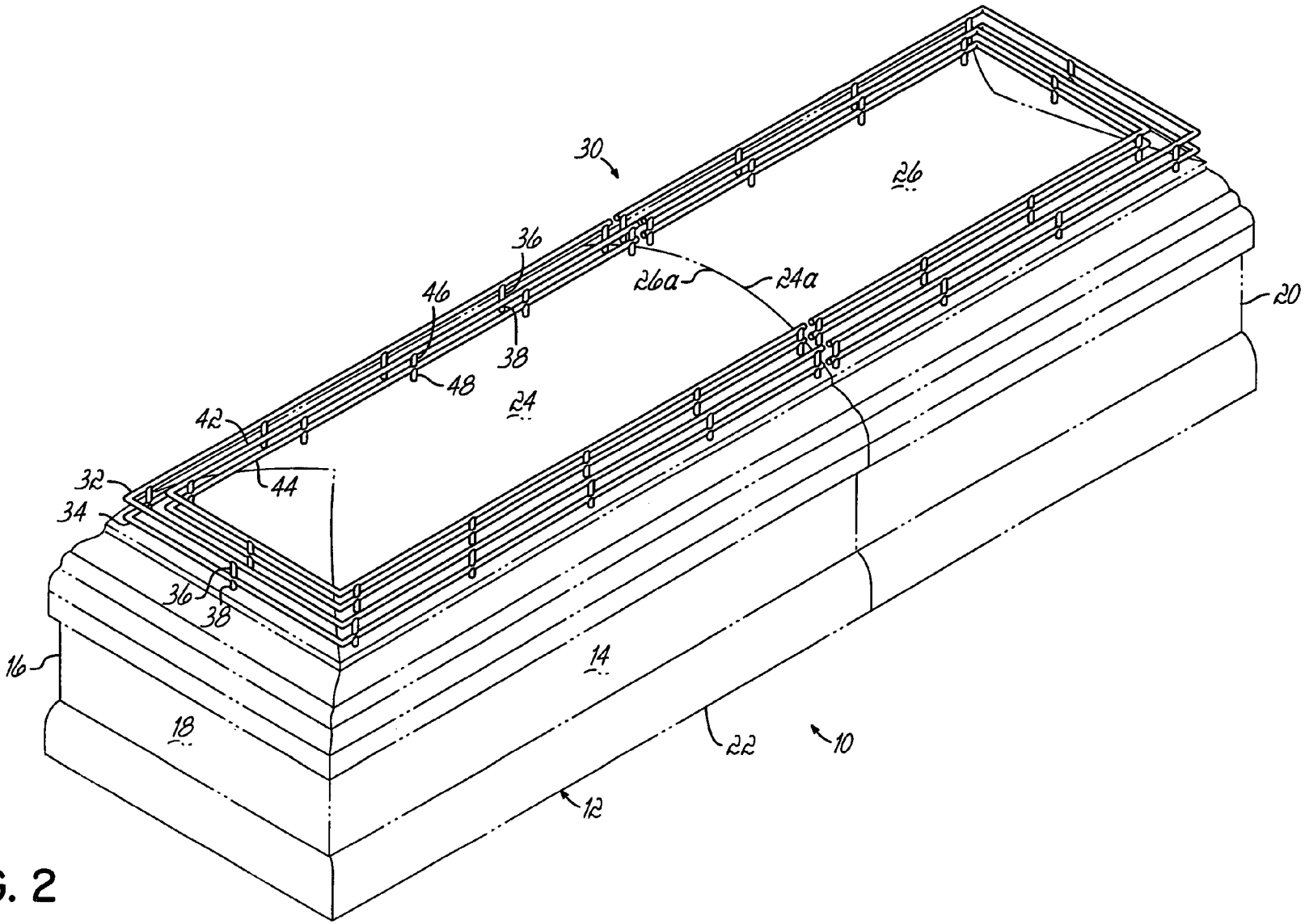
FIG. 2 is a view similar to FIG. 1 of another embodiment of memorabilia mounting device.

Referring to FIG. 2, memorabilia mounting device 30 can take the form of and outer rail pair and an inner rail pair. The outer rail pair can include upper and lower rails 32, 34 interconnected with interconnecting rail portions 36 and connecting rail portions 38 connecting lower rail 34 to lids 24, 26, as described above in reference to FIG. 1. The inner rail pair can include upper and lower rails 42, 44 interconnected with interconnecting rail portions 46 and connecting rail portions 48 connecting lower rail 44 to lids 24, 26.

Figure 4:
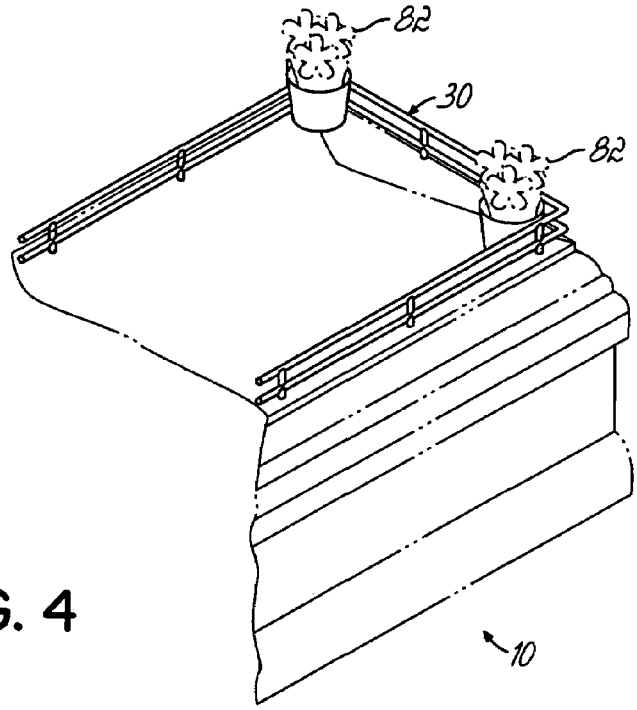
FIG. 4 is a partial perspective view of the casket of FIGS. 1-3 illustrating the mounting of the item of memorabilia directly to the memorabilia mounting device without the use of the memorabilia display device.

Referring now to FIG. 3, there are illustrated various memorabilia display devices 60 which can be attached to the memorabilia mounting device 30 for displaying memorabilia memorializing a deceased. The memorabilia display device 60 can be a wire rack 62 which defines a grid suitable for attaching a flower spray or the like thereto. Memorabilia display device 60 can be a table top 64 for supporting various items such as a picture frame 66, photos 68 or photo album 70. Memorabilia display device 60 can be a table register 72 which can include a first substantially horizontally extending portion 74 and can include a second inclined portion 76 integral with first portion 74. Table register 72 can include a lip 78 disposed at one end of the inclined portion 76. Accordingly, table register 72 is suitable for positioning a registration book on the inclined portions 76, resting on lip 78, so that loved ones of the deceased may conveniently sign a registration book. Memorabilia display device 60 can be tray 80 suitable for accepting flowers 82, or flowers 82 could be directly connected to memorabilia mounting device 30 as shown in FIG. 4.

Figure 5:
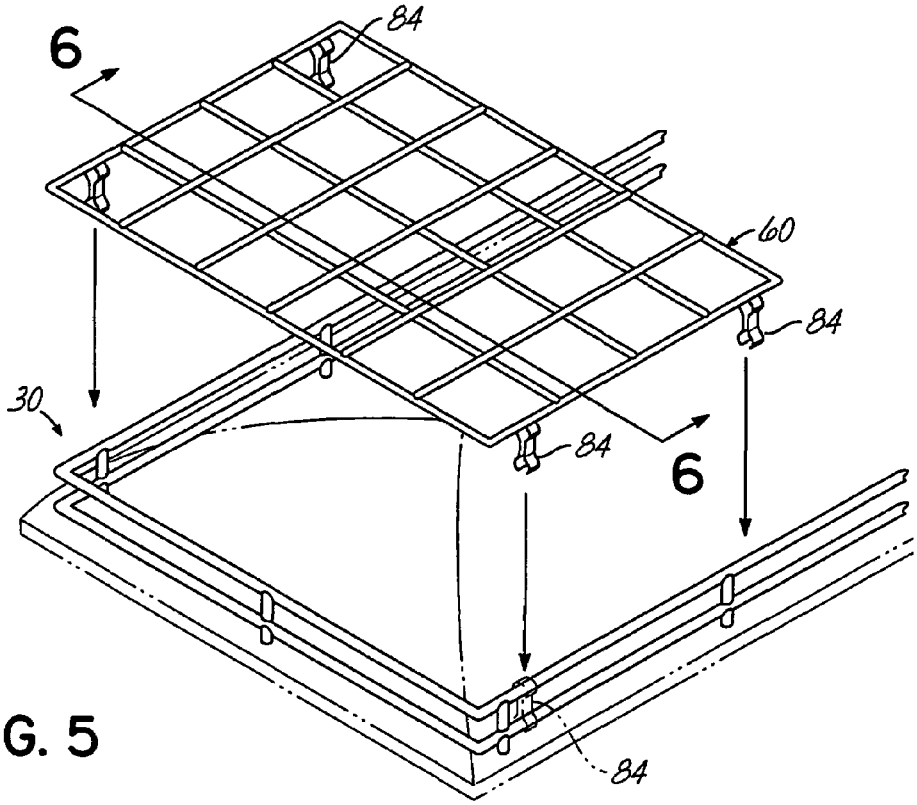
FIG. 5 is a partial perspective view of the casket of FIGS. 1-4 illustrating one means of attaching the memorabilia display device to the memorabilia mounting device.
Figure 6A:
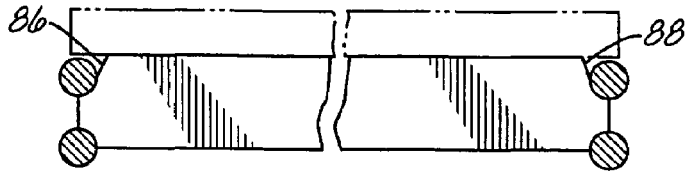
FIGS. 6A-6E are views taken along line 6-6 of FIG. 5 illustrating various alternative means of attaching the memorabilia display device to the memorabilia mounting device.
Figure 6B:
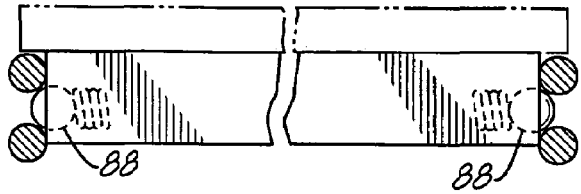
Figure 6C:
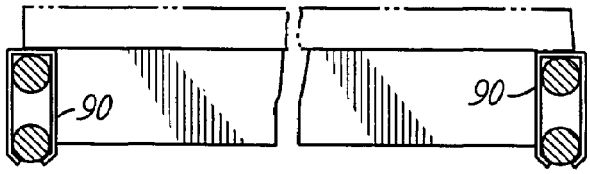
Figure 6D:
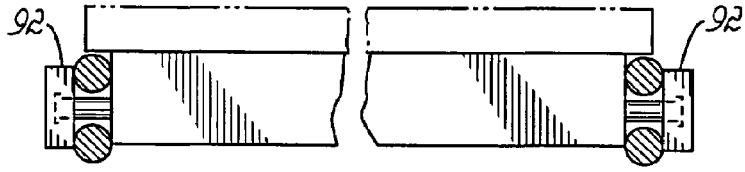
Figure 6E:
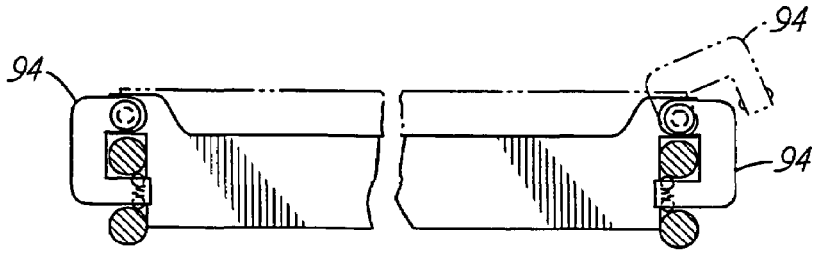
Figure 7:
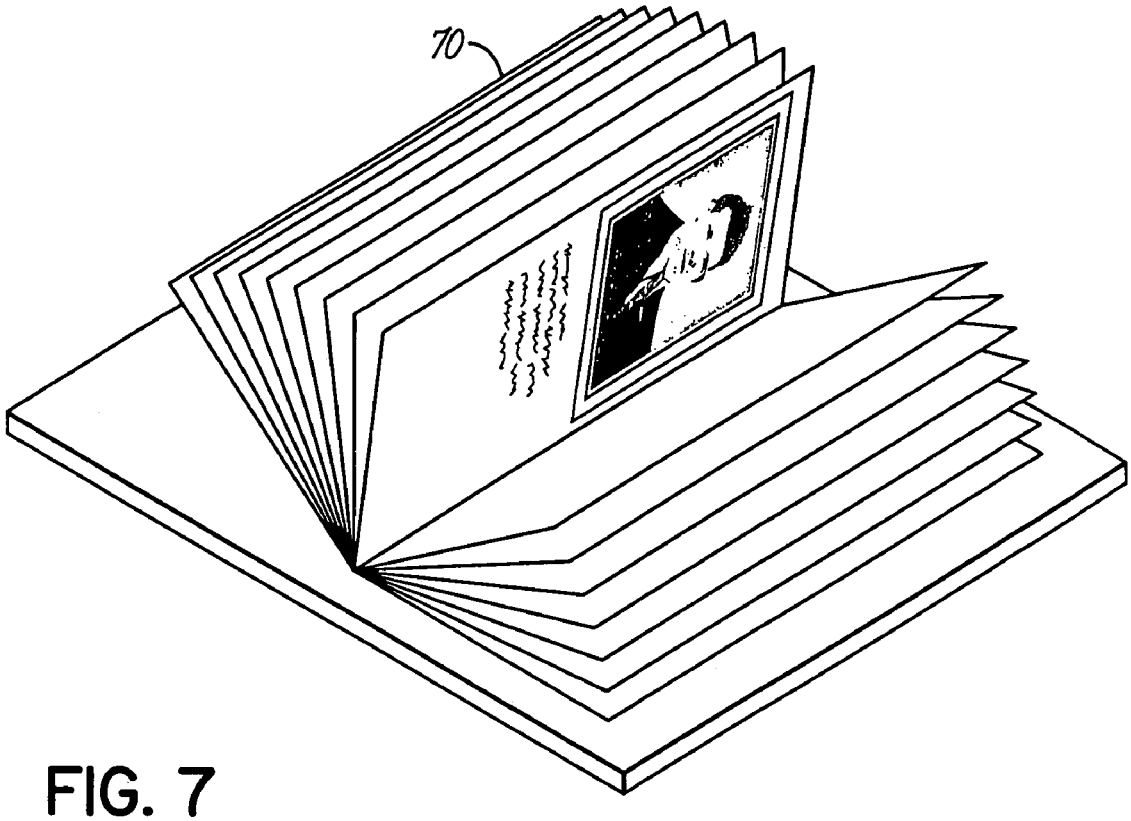
FIG. 7 is a perspective view of another memorabilia display device for mounting on the memorabilia mounting device.

FIG. 5 illustrates on means of attaching memorabilia display device 60 to memorabilia mounting device 30, namely spring clips 84. FIGS. 6A-6D illustrate other means of attaching memorabilia display device 60 to memorabilia mounting device 30, namely pressure fit tab locks 86, detent and ball mechanisms 88, flexible plastic clips 90, half turn locks 92, and spring loaded lever clamps 94.

Those skilled in the art will readily recognize numerous adaptations and modifications which can be made to the present invention which will result in an improved casket with memorabilia mounting and display devices, yet all of which will fall within the spirit and scope of the present invention as defined in the following claims. Accordingly, the invention is to be limited only by the scope of the following claims and their equivalents.

What is claimed is:

1. A casket comprising:

a casket shell having a pair of side walls, a pair of end walls, and a floor, at least one lid securable to said casket shell, said at least one lid including a pair of sides and a pair of ends, a memorabilia mounting device secured to said at least one lid and extending along at least a portion of a perimeter thereof, said memorabilia mounting device having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting device for displaying memorabilia memorializing a deceased, wherein said at least one lid comprises a pair of lids, said memorabilia mounting device extending along at least a portion of the perimeter of both of said pair of lids.

2. A casket comprising:

a casket shell having a pair of side walls, a pair of end walls, and a floor, at least one lid securable to said casket shell, said at least one lid including a pair of sides and a pair of ends, a memorabilia mounting device secured to said at least one lid and extending along at least a portion of a perimeter thereof, said memorabilia mounting device having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting device for displaying memorabilia memorializing a deceased, wherein said at least one lid comprises a pair of lids, said pair of lids having abutting end edges, said memorabilia mounting device extending along at least a portion of the perimeter of both of said pair of lids, excluding said abutting end edges of said lids.

3. A casket comprising:

a casket shell having a pair of side walls, a pair of end walls, and a floor, at least one lid securable to said casket shell, said at least one lid including a pair of sides and a pair of ends, a memorabilia mounting device secured to said at least one lid and extending along at least a portion of a perimeter thereof, said memorabilia mounting device having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting device for displaying memorabilia memorializing a deceased, wherein said at least one lid comprises a pair of lids, said pair of lids having abutting end edges, said memorabilia mounting device extending around the perimeter of both of said pair of lids, except said abutting end edges of said lids.

4. A casket comprising:

a casket shell having a pair of side walls, a pair of end walls, and a floor, at least one lid securable to said casket shell, said at least one lid including a pair of sides and a pair of ends, a memorabilia mounting device secured to said at least one lid and extending along at least a portion of a perimeter thereof, said memorabilia mounting device having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting device for displaying memorabilia memorializing a deceased, wherein said memorabilia mounting device is a rail.

5. A casket comprising:

a casket shell having a pair of side walls, a pair of end walls, and a floor, at least one lid securable to said casket shell, said at least one lid including a pair of sides and a pair of ends, a memorabilia mounting device secured to said at least one lid and extending along at least a portion of a perimeter thereof, said memorabilia mounting device having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting device for displaying memorabilia memorializing a deceased, wherein said memorabilia display device is a wire rack.

6. The casket of any of claims 1-3, wherein said memorabilia display device is a table top.

7. The casket of any of claims 1-3, wherein said memorabilia display device is a table register.

8. The casket of any of claims 1-3, wherein said memorabilia display device is a tray.

9. A casket comprising:

a casket shell having a pair of side walls, a pair of end walls, and a floor, at least one lid securable to said casket shell, said at least one lid including a pair of sides and a pair of ends, a memorabilia mounting rail secured to said at least one lid and extending along at least a portion of a perimeter thereof, said memorabilia mounting rail having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting rail for displaying memorabilia memorializing a deceased.

10. The casket of claim 9, said memorabilia mounting rail having a pair of said side portions, one of which corresponds to each of said sides of said at least one lid.

11. The casket of claim 9 wherein said at least one lid comprises a pair of lids, said memorabilia mounting rail extending along at least a portion of the perimeter of both of said pair of lids.

12. The casket of claim 9 wherein said at least one lid comprises a pair of lids, said pair of lids having abutting end edges, said memorabilia mounting rail extending along at least a portion of the perimeter of both of said pair of lids, excluding said abutting end edges of said lids.

13. The casket of claim 9 wherein said at least one lid comprises a pair of lids, said pair of lids having abutting end edges, said memorabilia mounting rail extending around the perimeter of both of said pair of lids, except said abutting end edges of said lids.

14. The casket of claim 9 wherein said memorabilia mounting rail includes interconnected upper and lower rails.

15. The casket of claim 9 wherein said memorabilia mounting rail includes an outer rail pair and an inner rail pair, said outer rail pair having interconnected upper and lower rails, said inner rail pair having interconnected upper and lower rails.

16. The casket of any of claims 9-15, wherein said memorabilia display device is a wire rack.

17. The casket of any of claims 9-15, wherein said memorabilia display device is a table top.

18. The casket of any of claims 9-15, wherein said memorabilia display device is a table register.

19. The casket of any of claims 9-15, wherein said memorabilia display device is a tray.

20. A casket comprising:

a casket shell having a pair of side walls, a pair of end walls, and a floor, at least one lid securable to said casket shell, said at least one lid including a pair of sides and a pair of ends, a memorabilia mounting rail secured to said at least one lid and extending along at least a portion of a perimeter thereof, said memorabilia mounting rail having a side portion corresponding to one of said sides of said at least one lid and an end portion corresponding to one of said ends of said at least one lid, said side and end portions fastened to said at least one lid by connecting portions, a memorabilia display device mounted to said memorabilia mounting rail for displaying memorabilia memorializing a deceased, and an attachment device for attaching said memorabilia display device to said memorabilia mounting rail.

21. The casket of claim 20, said memorabilia mounting rail having a pair of said side portions, one of which corresponds to each of said sides of said at least one lid.

22. The casket of claim 20 wherein said at least one lid comprises a pair of lids, said memorabilia mounting rail extending along at least a portion of the perimeter of both of said pair of lids.

23. The casket of claim 20 wherein said at least one lid comprises a pair of lids, said pair of lids having abutting end edges, said memorabilia mounting rail extending along at least a portion of the perimeter of both of said pair of lids, excluding said abutting end edges of said lids.

24. The casket of claim 20 wherein said at least one lid comprises a pair of lids, said pair of lids having abutting end edges, said memorabilia mounting rail extending around the perimeter of both of said pair of lids, except said abutting end edges of said lids.

25. The casket of claim 20 wherein said memorabilia mounting rail includes interconnected upper and lower rails.

26. The casket of claim 20 wherein said memorabilia mounting rail includes an outer rail pair and an inner rail pair, said outer rail pair having interconnected upper and lower rails, said inner rail pair having interconnected upper and lower rails.

27. The casket of any of claims 20-26, wherein said memorabilia display device is a wire rack.

28. The casket of any of claims 22-26, wherein said memorabilia display device is a table top.

29. The casket of any of claims 20-26, wherein said memorabilia display device is a table register.

30. The casket of any of claims 20-26, wherein said memorabilia display device is a tray.

31. The casket of claim 20 wherein said attachment device is a spring clip.

32. The casket of claim 20 wherein said attachment device is a pressure fit tab lock.

33. The casket of claim 20 wherein said attachment device is a detent and ball.

34. The casket of claim 20 wherein said attachment device is a flexible plastic clip.

35. The casket of claim 20 wherein said attachment device is a half turn lock.

36. The casket of claim 20 wherein said attachment device is a spring loaded lever clamp.

37. A casket comprising:

a casket shell having a pair of side walls, a pair of end walls, and a floor, at least one lid closable on said casket shell, said at least one lid including a pair of sides and a pair of ends, a memorabilia mounting rail on said at least one lid and extending along at least a portion of a perimeter thereof, said memorabilia mounting rail having a side portion corresponding to one of said sides of said at least one lid and an end portion corresponding to one of said ends of said at least one lid, said side and end portions fastened to said at least one lid by connecting portions, and a memorabilia display device mounted to said memorabilia mounting rail for displaying memorabilia memorializing a deceased.

38. A casket comprising:

a casket shell having a pair of side walls, a pair of end walls, and a floor, at least one lid closable on said casket shell, said at least one lid including a pair of sides and a pair of ends, a memorabilia mounting rail on said at least one lid and extending along at least a portion of a perimeter thereof, said memorabilia mounting rail having a side portion corresponding to one of said sides of said at least one lid and an end portion corresponding to one of said ends of said at least one lid, said side and end portions fastened to said at least one lid by connecting portions, a memorabilia display device mounted to said memorabilia mounting rail for displaying memorabilia memorializing a deceased, and an attachment device for attaching said memorabilia display device to said memorabilia mounting rail.

* * * * *